United States Patent [19]

Schippers et al.

[11] Patent Number: 4,504,021

[45] Date of Patent: Mar. 12, 1985

[54] RIBBON FREE WOUND YARN PACKAGE AND METHOD AND APPARATUS FOR PRODUCING THE SAME

[75] Inventors: Heinz Schippers; Erich Lenk; Gerhard Martens; Manfred Mayer, all of Remscheid; Werner Pieper, Radevormwald; Siegfried Putsch, Wuppertal-Cronenberg, all of Fed. Rep. of Germany

[73] Assignee: Barmag Barmer Maschinenfabrik AG, Remscheid, Fed. Rep. of Germany

[21] Appl. No.: 476,852

[22] Filed: Mar. 18, 1983

[30] Foreign Application Priority Data

| | | | |
|---|---|---|---|
| Mar. 20, 1982 | [DE] | Fed. Rep. of Germany | 3210244 |
| May 3, 1982 | [DE] | Fed. Rep. of Germany | 3216334 |
| May 11, 1982 | [DE] | Fed. Rep. of Germany | 3217562 |
| May 27, 1982 | [DE] | Fed. Rep. of Germany | 3219880 |

[51] Int. Cl.[3] ..... B65H 54/38

[52] U.S. Cl. ..... 242/18.1; 242/174

[58] Field of Search ..... 242/18.1, 43 R, 159, 242/174–178

[56] References Cited

U.S. PATENT DOCUMENTS

| | | | |
|---|---|---|---|
| 2,763,824 | 9/1956 | Bacheler | 242/18.1 X |
| 3,137,987 | 6/1964 | Potts | 57/55.5 |
| 3,235,191 | 2/1966 | Engelman et al. | 242/18.1 |
| 3,241,779 | 3/1966 | Bray et al. | 242/18.1 |
| 3,451,209 | 6/1969 | Bisset et al. | 57/156 |
| 3,452,533 | 7/1969 | Bisset et al. | 57/156 |
| 3,452,534 | 7/1969 | Bisset et al. | 57/156 |
| 3,488,938 | 1/1970 | Johnson et al. | 57/98 |
| 3,514,682 | 5/1970 | Corey | 242/18.1 X |
| 3,638,872 | 2/1972 | Jennings | 242/18.1 |
| 3,643,415 | 2/1972 | Mackie | 56/117 |
| 3,727,855 | 4/1973 | Richter | 242/18.1 |
| 3,799,463 | 3/1974 | Peckinpaugh | 242/18.1 |
| 3,910,514 | 10/1975 | Hooper | 242/18.1 |
| 4,060,208 | 11/1977 | Raasch | 242/18.1 |
| 4,181,877 | 1/1980 | Gemp | 242/18.1 X |
| 4,296,889 | 10/1981 | Martens | 242/18.1 |
| 4,325,517 | 4/1982 | Schippers et al. | 242/18.1 |
| 4,377,263 | 3/1983 | Guelpa | 242/18.1 |

FOREIGN PATENT DOCUMENTS

| | | | |
|---|---|---|---|
| 1535055 | 5/1970 | Fed. Rep. of Germany . | |
| 2914924 | 10/1980 | Fed. Rep. of Germany . | |
| 45-41060 | 12/1970 | Japan | 242/18.1 |
| 1186227 | 4/1970 | United Kingdom . | |
| 1273314 | 5/1972 | United Kingdom . | |

OTHER PUBLICATIONS

L'Industrie Textile, 1966, pp. 689–691.

Journal of the Textile Institute, Transactions, vol. 51, No. 7, Jul. 1960, pp. T265–T270.

*Primary Examiner*—Stanley N. Gilreath

*Attorney, Agent, or Firm*—Bell, Seltzer, Park & Gibson

[57] ABSTRACT

A method and apparatus for producing a ribbon free randomly wound yarn package is disclosed, and wherein a plurality of critical winding ratios at which undesirable pattern formations or ribbons would normally occur are determined and stored in a microprocessor control unit. During the winding operation, the spindle speed and traversing frequency are monitored by sensors and are transmitted to the control unit, and the control unit computes the optimum time for rapidly changing the traversing frequency so that the actual winding ratio moves rapidly through each of the approaching critical winding ratios. The original traversing frequency is re-established after having passed beyond each of the critical winding ratios.

6 Claims, 19 Drawing Figures

RIBBON FREE WOUND YARN PACKAGE AND METHOD AND APPARATUS FOR PRODUCING THE SAME

The present invention relates to the winding of textile yarns into core supported packages, and more particularly to a method and apparatus for winding yarns into packages while avoiding the formation of undesirable patterns or ribbons in the windings.

In conventional yarn winding procedures, the yarn is reciprocated perpendicularly to its traveling direction over a certain distance (i.e., stroke), which essentially corresponds with the winding length. This reciprocating travel of the yarn is described as traverse, and a characteristic measurement for the traverse speed is the rate of double strokes. A double stroke is considered to be the sum of two successive strokes, i.e., of one forward stroke and one return stroke, and the rate of double strokes is the number of double strokes per unit of time. If the speed of the core supporting spindle per unit of time and the rate of double strokes are interdependent, for example, by reason of an operative connection between spindle and traverse motion drive, a precision cross wind will be produced.

As opposed to a precision winding operation, the present invention deals with all kinds of winding in which the speed of the spindle is not constantly dependent on the rate of double strokes, known as random cross wind, or random wind. In particular, the invention deals with cross winds which, according to DIN 61 801 (German Industrial Standards), are characterized by a constant ratio of the double stroke rate and the circumferential speed of the package. In a narrower sense of DIN 61 801, random cross winds are especially utilized in winding synthetic filament yarns, which are delivered at a constant high speed after they have been produced or processed.

In random winding, the circumferential speed of the package is obtained by a tangential drive, such as by means of a drive roll which is driven at a constant speed and rests against the circumference of the package, or by measuring and regulating the circumferential speed of the package, consequently the rotational speed of the spindle (rotations per minute) will decrease hyperbolically during the course of package build. The traverse speed, i.e., the double stroke rate, is constant (DIN 61 801), or is slightly varied, but without a fixed ratio to the speed of the spindle. As a consequence, during the course of the package build, the winding ratio, i.e., the ratio of spindle speed and traverse speed also decreases hyperbolically. When producing random winds in the sense of this invention, there is a risk that "patterns" or "ribbons" develop in areas of the winding cycle. In the following description, this phenomenon is referred to simply as "ribbons."

In areas where ribbons occur, the yarn segments of several successively wound layers are directly superposed, thereby incurring the risk that the superposed yarn segments may slip sideways and thus jam each other. Therefore, ribbons adversely affect the unwinding properties of packages, which leads to yarn breaks and possible destruction of the package. However, ribbons also produce a centric and axial asymmetry of the packages and thus an asymmetrically distributed package hardness, package density and mass distribution. They further lead to an asymmetrical contact pressure when drive rolls are used, and to vibrations during the takeup process and damage of delicate yarn material.

A ribbon develops in the areas of the winding cycle in which the winding ratio results in an integer. Intermediate ribbons develop when the winding ratio deviates by a fraction with a small denominator, in particular, $\frac{1}{2}$, $\frac{1}{3}$, from an integral winding ratio.

When intermediate ribbon values are produced, layers with superposed lengths of yarn and properly wound layers, i.e., lengths of yarn wound next to each other, repeatedly follow each other. Therefore, when intermediate ribbons occur, the unwinding properties of the package are less adversely affected. However, the package is adversely affected by the development of imbalances and asymmetries in the package.

Winding ratios, during which ribbons or intermediate ribbons occur, are identically described herein as ribbons or ribbon ratios. Ribbons of a greater magnitude are those with a greater ribbon ratio. It is known to break a ribbon by continuously aperiodically varying the double stroke rate, with the variation being within predetermined narrow limits. In doing so however, it cannot be avoided that when the winding ratio approaches a ribbon ratio, particularly an integral ribbon ratio, the ratio is passed through repeatedly and with a certain duration of dwell. This procedure for breaking a ribbon therefore does not eliminate the passage through the ribbon values, but only eliminates or eases the symptoms of the ribbons, note for example, U.S. Pat. No. 3,235,191 and corresponding Swiss Pat. No. 416,406.

It is also known to effect the breaking of a ribbon by temporarily lowering the traverse speed, i.e., the rate of double strokes, when the winding ratio approaches a ribbon ratio, and it is increased again to its initial value when the ribbon area is passed, note German Offenlegungsschrift No. 2,914,924.

It is accordingly an objective of the present invention to provide an improved method and apparatus for producing a ribbon-free wound yarn package.

This object is achieved in accordance with the present invention by the provision of a method and apparatus which includes the steps of determining a plurality of critical winding ratios at which undesirable pattern formations would normally occur, determining a safety distance from each of the critical winding ratios, and rapidly changing the double stroke rate upon the distance between the actual winding ratio and an approaching critical winding ratio being equal to the predetermined safety distance. The resulting change in the winding ratio (also referred to herein as the jump distance) is preferably equal to at least twice the safety distance.

The predetermined safety distance is here understood to be equal to or slightly greater than a minimum safety distance, the determination of which will be described below. This minimum safety distance is the lowest allowable difference between the winding ratio and an approaching ribbon or intermediate ribbon. The minimum safety distance must be maintained from both the winding ratio which results from the initial value of the traverse speed, and from the winding ratio which results from the ribbon breaking value of the traverse speed. When the winding ratio reaches or approaches this minimum safety distance from a critical ratio, the traverse speed is changed and thus the winding ratio is changed. The invention provides that the traverse speed is so changed that there is a sudden change of the winding ratio. This change of the winding ratio is sufficient so that the changed winding ratio is outside the safety distance. The safety distance is here described as the range of those winding ratios from a ribbon value or an intermediate ribbon value, either to the positive or to the negative side. This means that the jump distance of the winding ratio is at least equal to twice the minimum safety distance. The thus characterized method is based upon the recognition that there is a risk that ribbon symptoms may occur at a distance before and after each ribbon ratio, and that such a risk depends on the magnitude of the ribbon and on the jump distance.

According to the invention it is not necessary that the predetermined safety distance be restricted to the minimum safety distance, and a greater safety distance can be predetermined. To also quickly pass through the safety range in this event, the jump distance should be the same as or greater than two times the predetermined safety distance. In this application, the safety distance of the winding ratio when it approaches a ribbon ratio is referred to as S1, and the safety distance of a winding ratio after the traverse speed has been changed is referred to as S2. Both need not, but can be and preferably are identical, and in any event are greater than or the same as the minimum safety distance.

From the above, it will be understood that the phrase "safety distance" as used herein means a numerical value determined for example from the difference between two winding ratios, such as the actual winding ratio and a ribbon producing winding ratio. In addition, the numerical values may be determined as a fraction p of the ribbon ratio to be avoided, or the actual winding ratio resulting from the division of the instantaneous measurement of the spindle speed by the traverse speed. The practical difference between these two bases for calculating the fraction p is important only from the standpoint of the necessary setup of the electronic control, for which, in both cases, suitable means are made available to the person skilled in the art. The difference of the safety distance resulting from the described ways of calculating the fraction P, however, is so small and can be neglected from the point of textile technology.

Fraction p is preferably constant over several successive ribbons. However, it can also be varied when it is found by experience that ribbon symptons, especially with ribbons of a smaller magnitude, are to be expected relatively early before reaching a ribbon value. In the order of magnitude, p amounts to less than 5% and, in general, to more than 0.1%. Fraction p is to be determined by tests, or, as will be explained in detail below, from the textile data of the takeup process. In doing so, the minimum safety distance is the safety distance which should by no means fall short, especially not when the winding ratio approaches a ribbon ratio or an intermediate ribbon ratio. In such case, the risk of ribbons is greater, and the ribbon symptoms are more serious than in the case where the winding ratio moves away from the ribbon ratio or intermediate ribbon ratio.

As already explained, the safety distance S and the minimum safety distance can be determined by experimental results. Alternatively and in supplementation thereto, the invention provides that the safety distance S is proportional to the ribbon ratio and to the smallest allowable distance (A) between adjacent yarns of two successive windings, which are measured from yarn center to yarn center along the surface line of the package, and that it is inversely proportional to two times the stroke (H).

In this determination, the magnitude of the ribbon is initially considered, but primarily the yarn character. Depending on the denier and filament number, the yarn wound on the packages spreads perpendicularly to its axis. To avoid ribbon symptoms, it is therefore necessary that the adjacent yarns of two successive windings are at a minimum distance from each other, so that ribbon phenomena do not occur. This distance can be determined by tests. However, this distance can also be fairly accurately estimated by the yarn character, especially yarn denier, filament number, filament denier, cohesion of filaments, resulting for example, by snarls, entanglements, finish oil, and takeup tension.

From this teaching of the invention it also results that the safety distance must be all the greater, the shorter the winding length is. This is advantageous for the following reason: a shorter winding length produces a relatively high rate of double strokes. Therefore, ribbons of a low magnitude particularly develop which are especially damaging. These ribbons distribute irregularly over the package, due to the short winding length, so that they result in an axially and/or radially asymmetrical mass distribution of the yarn on the package and destroy the package at high yarn speeds. According to the invention, this is avoided by the inversely proportional dependence of the safety distance from the winding length.

From the above, it can be seen that factor p may be determined according to the formula A/2H. In the place of yarn distance A, the width B of the yarn wound on the package and measured on the surface line of the package may also be used so that factor p equals B/2H. If the minimum safety distance resulting therefrom is disregarded, ribbon symptons will likely occur.

The invention further provides that by predetermining a safety distance, the variation of the traverse speed is also predetermined since according to the invention the safety distance and the jump distance are interrelated. Specifically, the ratio Q (jump distance/safety distance) is predetermined over at least two ribbons, and preferably, over a plurality of ribbons. Also, the jump distance equals at least the sum of the predetermined and the minimum safety distance. This dependence of the jump distance with the safety distance and the minimum safety distance is significant in avoiding the ribbon symptoms.

To prevent damaging ribbon symptons from occurring when the winding ratio passes through a ribbon or an intermediate ribbon, it is provided that the traverse speed and thus the winding ratio is varied as rapidly as possible. For this purpose, it is provided that the drive parameter of the traverse motion drive which controls the traverse speed, i.e., the voltage or frequency, is varied in a step function, preferably by superposing a differential increment. In other words, the drive parameter is first changed to a higher value than the nominal value when the speed is increased, or conversely, switched to the nominal value only after a certain period of time. However, it is unavoidable that the traverse motion drive starts to operate only with a delay which is predetermined by the changed drive parameter. Consequently, it is also unavoidable that the winding ratio changes with a finite acceleration or deceleration. Aside from the technically unfeasible case of an infinitely high acceleration or deceleration, and aside from the borderline case of a constant acceleration or deceleration, it should here technically be differentiated between the case of an initially high constant and then decreasing acceleration or deceleration (function defining a variation with a delay of first order), and the case of an initially increasing and then again decreasing acceleration and deceleration of the traverse speed (function defining a variation with a delay of second or higher order).

Should it be found that the changing winding ratio passes through the range of the ribbon ratio with so little acceleration or deceleration, that damaging ribbon symptoms develop, ratio Q can be increased. Use is made of this method, especially when the traverse speed, and thus the winding ratio, is varied with an initially high and then decreasing acceleration, i.e., with a function of variation of the traverse speed or winding ratio having a delay of first order. On the other hand, a greater safety distance S than the minimum distance S can be selected, and the jump distance can be made equal the sum of safety distance and minimum safety distance. Use is made of this method, especially when acceleration or deceleration of the traverse speed, and thus of the winding factor, first steadily increases from zero or a low value up to a maximum, i.e., with a function of variation of the traverse speed or winding factor having a delay of second and higher order. This, for example, is to be expected when the changed traverse speed is transmitted via a slip clutch.

From the above, it will be seen that the invention provides that the safety distance and the jump distance of the winding factor are so predetermined and related with each other that the changing winding ratio passes through the ribbon ratio in the shortest period of time, i.e., that the variation of the winding ratio, which results from the change of the traverse speed, intersects the ribbon ratio and its safety range from the ribbon ratio plus safety distance S1 to the ribbon ratio minus safety distance S2 in the area of its steepest slope.

The ribbon-breaking value of the traverse speed is maintained for only a certain period of time. The subsequent variation of the traverse speed from the ribbon-breaking value to the initial value, and the resulting change of the winding ratio, occurs only when the spindle speed has dropped so far that the safety distance between the avoided ribbon ratio and the winding ratio is restored, which winding ratio results from the division of the spindle speed by the initial value of the traverse speed.

To avoid ribbon ratios, the traverse speed can be increased or decreased from its initial value NCA. The ribbon breaking value NCS of the traverse speed may be either greater or less than the initial value NCA. In any event, the initial value and the ribbon-breaking value are preferably kept constant during the entire winding cycle, or at least during an essential part of thwe winding cycle, especially when a plurality of takeup positions has a common traverse motion drive.

If the traverse speed is lowered, when the winding ratio enters the safety distance from the next approaching ribbon value, the winding ratio increases, and its reaching the ribbon ratio is initially delayed. Upon the spindle speed dropping so far that the winding ratio resulting from the ribbon breaking value of the traverse speed (ribbon breaking winding factor) reaches the predetermined safety distance, the traverse speed will again be increased to its initial value, thereby lowering again the winding ratio and the ribbon ratio will be passed. Here again, it is important that this take place in the shortest possible time. According to the invention, this is also done, on one hand, by rapidly changing the drive parameter which is decisive for the traverse speed, and, on the other, by selecting a ratio Q (jump distance of winding ratio/safety distance) greater than two, or by having a selected safety distance S greater than the minimum safety distance, and a jump distance at least equal to the sum of the selected and the minimum safety distances.

As long as the ratio Q is greater than two, and it is not important to pass through the ribbon ratio as quickly as possible, the switchover can occur beforehand and at the earliest, when the spindle speed has dropped so far that the initial winding ratio reaches the predetermined safety value from the ribbon ratio. As long as the ratio Q is greater than two, and a delay of second and higher order is to be expected when the traverse speed is increased, the switchover must occur beforehand and then, when the spindle speed has dropped so far that the initial winding factor again reaches and exceeds the predetermined minimum safety distance from the ribbon value.

If the traverse speed is increased when the winding ratio enters the safety distance from a ribbon value, the winding ratio is thus decreased, and the ribbon value is quickly passed. According to the invention, this is achieved as follows: when the traverse speed is increased with a delay of first order, a minimum safety distance is predetermined, i.e., it is predetermined as a minimum safety distance, but the ratio Q is selected greater than 2. In doing so, it is achieved that the safety range of the ribbon is passed with high acceleration.

If a delay of second or higher order is to be expected when the traverse speed is increased, a safety distance is predetermined which is greater than the minimum safety distance, and a jump distance is predetermined which essentially equals the sum of the safety distance and minimum safety distance. Proceeding in this manner, it is also achieved that the safety range of the ribbon is passed with maximum acceleration. Use of rapidly passing ribbon areas and of the described action which is required therefor, is particularly significant for the especially damaging ribbons which are smaller than 4.

The increased ribbon breaking value of the traverse speed is maintained until the spindle speed has dropped so far that the initial winding ratio reaches again the safety distance from the ribbon ratio. Since for technical reasons the magnitude of this delay of the traverse speed is limited, a switchover may also occur somewhat earlier, or also somewhat later.

Increasing the traverse speed for the purpose of breaking a ribbon is advantageous in that an impairment of the package build is avoided or at least reduced. Increasing the traverse speed also reduces the actual winding stroke of the yarn wound on the package. Therefore, the danger that layers of yarn may slip out from the end faces of the package due to a too long stroke is minimized. Therefore, this ribbon breaking procedure is preferred.

The initial value NCA of the traverse speed is determined by the desired package build, and in particular by the desired angle of crossing. Thus, for example, when winding synthetic flat yarn on spinning or drawing machines, the crossing angle ranges from 5 to 12 degrees, preferably from 6 to 9 degrees. The decisive factor here is the quality of the package build. The traverse speed, expressed as rate of double strokes, then results from the predetermined yarn speed and the predetermined winding or stroke length.

Within the framework of this invention, the variation DC of the traverse speed ranges from about 0.2 to 5%, preferably from about 1 to 5% of the initial value NCA of the previously determined traverse speed. Within these limits, the variation DC of the traverse speed should be selected so that the yarn speed, when flat yarn is wound, i.e., non-textured synthetic filament yarn, does not vary by more than 0.1% when the traverse speed is changed, and by not more than 0.5% when textured synthetic filament yarn is wound. This avoids the need to compensate for the change of the takeup yarn speed which is caused by the variation of the traverse speed, by means of a suitable variation of the circumferential speed of the package, i.e., of the drive roll speed. The variation of the traverse speed is also limited in that, when the traverse speed is switched to ribbon breaking value and the ribbon breaking value is maintained for a period of time, a neighboring ribbon ratio or intermediate ribbon ratio having damaging effects should not be reached.

The above described teaching of the invention deals with the prevention of ribbon symptoms in sequence of ribbons and intermediate ribbons, which follow each other in their order. In addition, the invention involves the recognition that not all ribbon ratios lead to damaging results. This applies in particular to ribbons of a greater magnitude, which develop at the beginning of the winding cycle when the package diameter is small, and therefore the spindle speed is very fast. Likewise, however, it can also happen that not all ribbons have a damaging effect, and some intermediate ribbons may be passed without ribbon symptoms. For this reason, it is proposed that the ribbon ratios which are to be jumped are freely programmable. This makes it possible to adapt the ribbon breaking method according to the invention to the respective takeup process (winding speed, traverse speed, yarn material, finish oil and other parameters). The advantage is found in that unnecessary changes of the traverse speed and thus also impairments of the package build, which often are connected with the change of the traverse speed, are avoided.

The invention is further based on the recognition that the ribbon symptoms also differ from ribbon to ribbon. It is, therfore, preferably proposed that the safety distance is predetermined as a function of the ribbon ratios to be jumped, and preferably is freely programmable. Here, it can be particularly suitable to make the safety distance of the intermediate ribbons smaller than the safety distance of the integral ribbons. As described, this action, however, may also serve the purpose of rapidly passing through all ribbon ratios with their safety ranges, which is particularly suitable when the ribbon ratios are under 4.

Likewise, it is preferred that the ratio Q be predetermined as a function of the ribbon ratios to be jumped, and is preferably freely programmable. It can also be achieved thereby that the ribbons, which show especially clear and damaging symptoms, may be passed faster than other ribbons. With ribbons of a lesser magnitude, especially those having a value less than six, it is provided that the ratio $Q>2$.

The foregoing steps of influencing S and Q can be combined in such a manner that the variation of the traverse speed remains predetermined during the course of the winding cycle.

The ribbon breaking value of the traverse speed which is to be adjusted, can also be programmed. For a better illustration, it should be emphasized that the safety distance in the sense of this application is freely programmable, but is preferably dependent from the ribbon according to the formula $S=FSP\times p$. This applies in particular, when factor p is a predetermined constant for all or a group of ribbons. This constant predetermination is primarily considered, when determining p is based either according to the formula $p=A/2H$, on the center to center distance of the yarn on the package, or according to the formula $p=B/2H$, on the winding width of the yarn on the package.

Factor p can also be varied during the course of the winding cycle, especially according to an inserted program from ribbon to ribbon or groups of ribbons, for example, integral ribbons on one hand, and intermediate ribbons on the other, or ribbons of a great magnitude on the one hand, and ribbons smaller than 4 on the other.

To supplement the method of breaking ribbons according to the invention, it is proposed that ribbons, which occur at the end of the winding cycle, can be avoided by discontinuously or preferably continuously lowering the traverse speed toward the end of the winding cycle. This can be done in such a manner that the winding ratio remains constant, when the traverse speed is lowered at the same ratio as is the spindle speed. In doing so, the last layers of the winding cycle are precision wound.

The method according to the invention leads to a product which heretofore could not be made. Thus, it has been impossible to effectively produce spun hosiery yarn packages in a usable form on a spinning or spin-draw machine with a diameter greater than $H/pi\times$ tangent alpha, and a stroke of not more than 120 mm. A hosiery yarn is particularly a polyamide (nylon) 6,6 non-textured yarn with a denier range from 10 to 15 dtex.

Today, such polyamide 6,6 yarns are spun at spinning speeds of more than 4,500 m/min. and are highly oriented and wound to spun yarn packages at a takeup speed of more than 4,500 m/min. Due to the low denier and the desirable high production rate of a spinning position, several filaments are therefore simultaneously spun on a spinning position and wound to a corresponding number of packages. For reasons of machine design and construction, the length of these packages is limited and measures from 70 to 120 mm long, depending on the number of packages per spinning position. The angle of crossing of such packages is normally between 6.5° and 8.5°. It has heretofore not been possible to produce such packages with a larger diameter than the one given, since these packages were damaged and destroyed by ribbons and intermediate ribbons of a small magnitude. The spun yarn packages of polyamide 6,6 hosiery yarn are characterized in that in their diameter range $D=H/pi\times$ tangent alpha, the average winding angle is rapidly altered, preferably increased up to twenty minutes.

It should be mentioned here that the winding angle is not constant over the length of the package, but is, especially on the edges, partially greater and partially less than in the intermediate area. The average winding angle is here defined as the angle, the tangent of which results by way of calculation from the average traverse speed and the circumferential speed of the package. The average traverse speed again results from the constantly predetermined speed, the number of grooves and the stroke of, for example, the grooved roll or cross-spiralled roller of the traverse motion device. According to the invention the winding angle is increased in a certain range before and after the defined diameter, but, preferably, only to $\pm B/2H\times 100\%$ of the defined diameter, B being again the width of the yarn measured on the surface line of the package. When the package diameter is further increased, the winding angle is correspondingly increased or decreased respectively in the range of the diameter $D=1.33H/pi\times$tangent alpha.

Considerable difficulties have heretofore also been found in the production of spun yarn packages of polyester flat yarns with a denier of more than 50 dtex, in particular in the range from 78 to 167 dtex, when this polyester, especially polyethylene terephthalate flat yarn, had a high number of filaments, i.e., more than 40, or a correspondingly low denier of the individual filament, i.e., 2.4 to 7 dtex in the medium fine range and 1.0 to 2.4 dtex in the fine range. Such a problem also arose in the production of spun yarn packages of polyester non-textured yarn with a noncircular filament cross-section, having more than four lobes, and being primarily octolobal.

It has also been impossible to produce packages of a shorter length, for example of less than or equal 240 mm, and of a larger diameter than $D=2H/3$ pi$\times$tangent alpha. According to the invention, this problem is solved in that the average winding angle is altered, i.e. increased or decreased respectively at least in the range of the diameters $D=2H/3$ pi$\times$tangent alpha, as well as $D=H/pi\times$tangent alpha as well as $D=2H/1.5\times pi\times$tangent alpha for up to 20 minutes. This increase again covers a diameter range $D(1\pm B/2H)$ and at the most a diameter range $D(1\pm 1\%)$. FIG. 3*b* is a perspective view of a length of yarn with a high number of individual filaments. The yarn, especially when twisted, takes up an approximately round configuration, so that a diameter D can be defined. However, when the same yarn is wound in layers into a tube or package, the individual filaments spread out with a certain width B, which is measured on the surface line of the tube or package.

Additional objects and advantages of the present invention will become apparent from the following detailed description, in which FIG. 1 is a schematic cross-sectional view of a yarn winding machine for synthetic filament yarns, and which embodies the present invention;

FIG. 2 is a schematic view of the cross-wound package shown in FIG. 1;

FIG. 3*a* illustrates the development of a ribbon on a cross-wound package;

FIG. 3*b* is a perspective view of a length of yarn with a large number of individual filaments;

FIG. 3*c* is a partly sectioned view of the yarn of FIG. 3*b* wound on a winding tube or core;

FIG. 4 is a graph illustrating the winding ratio during the course of a winding opreation, and illustrating the method of the present invention;

FIG. 4*a* is an enlargement of the portion of the graph of FIG. 4 within the dashed circle;

FIG. 4*b* is similar to FIG. 4*a*, but illustrates an alternative embodiment of the method of the present invention;

FIG. 5 is a graph illustrating the winding speed and traverse speed during the course of a winding operation, and in accordance with a further embodiment of the present invention;

FIGS. 5*a*, 5*b*, and 5*c* show various embodiments of the method generally shown in FIG. 5;

FIGS. 6*a* and 6*b* are graphs illustrating separate embodiments of the procedure for changing the traverse speed;

Figure 1:
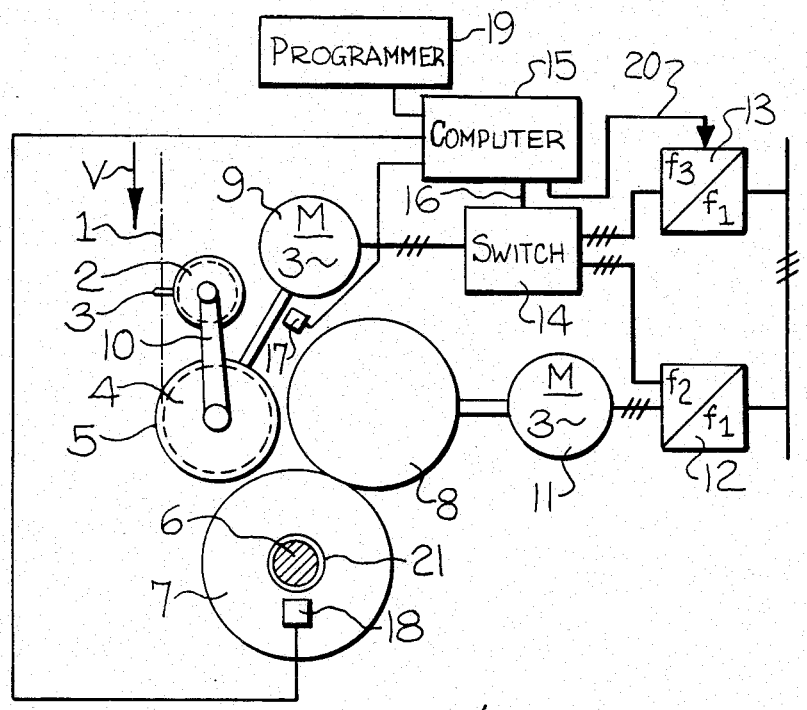
Figure 5:
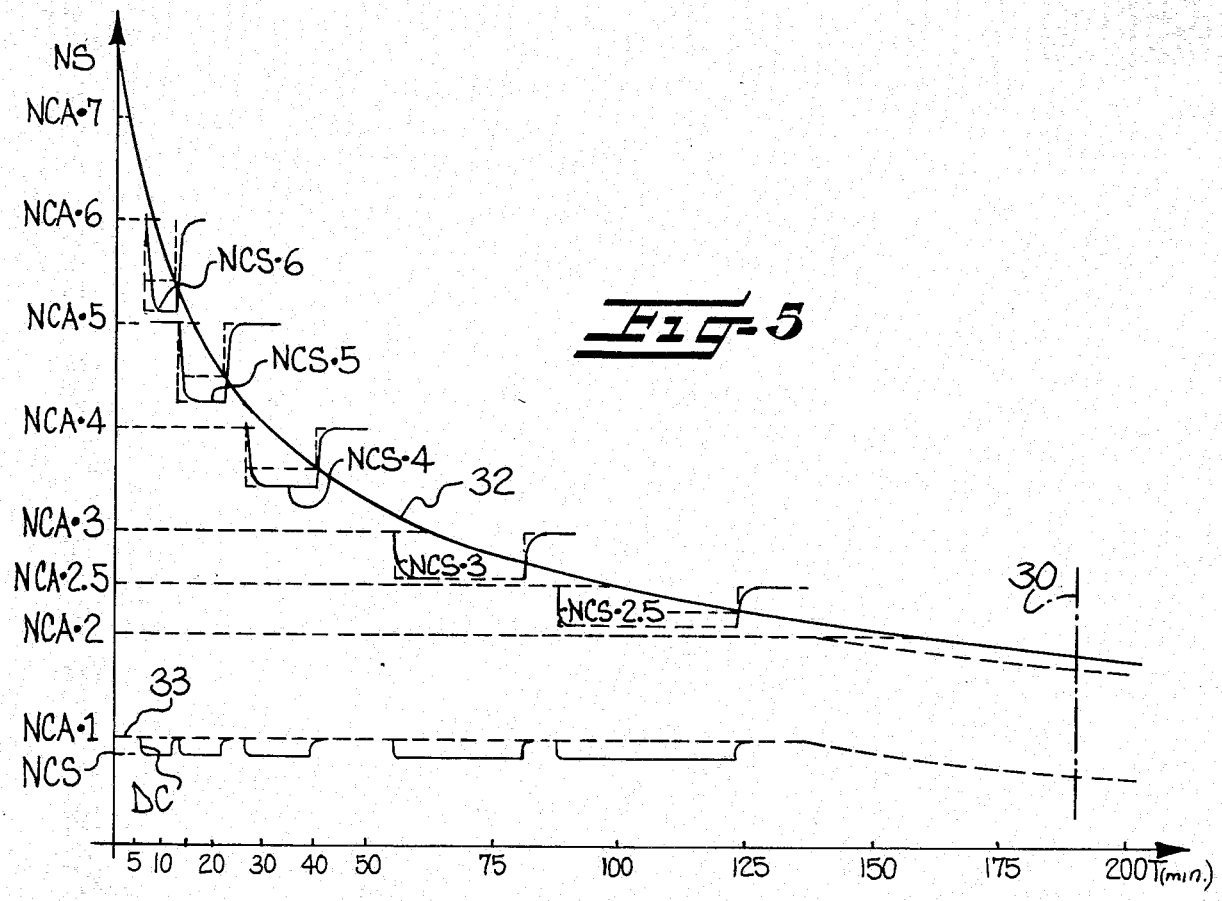
Figure 9:
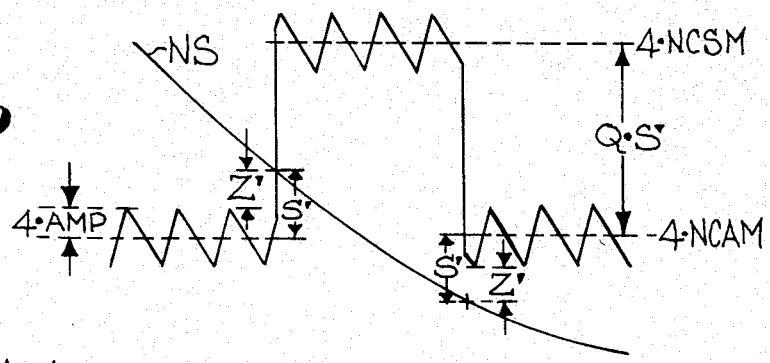
Figure 10:
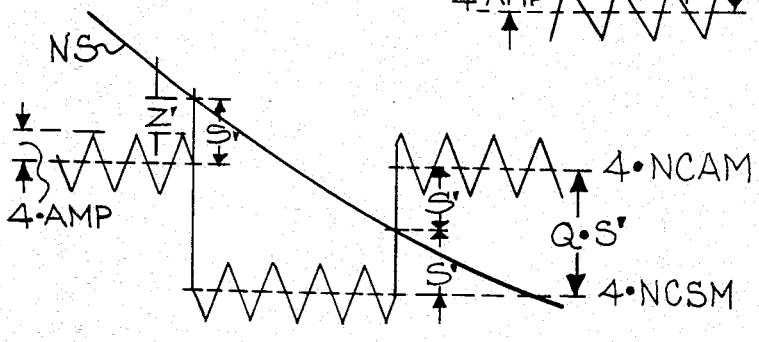
Figure 11:
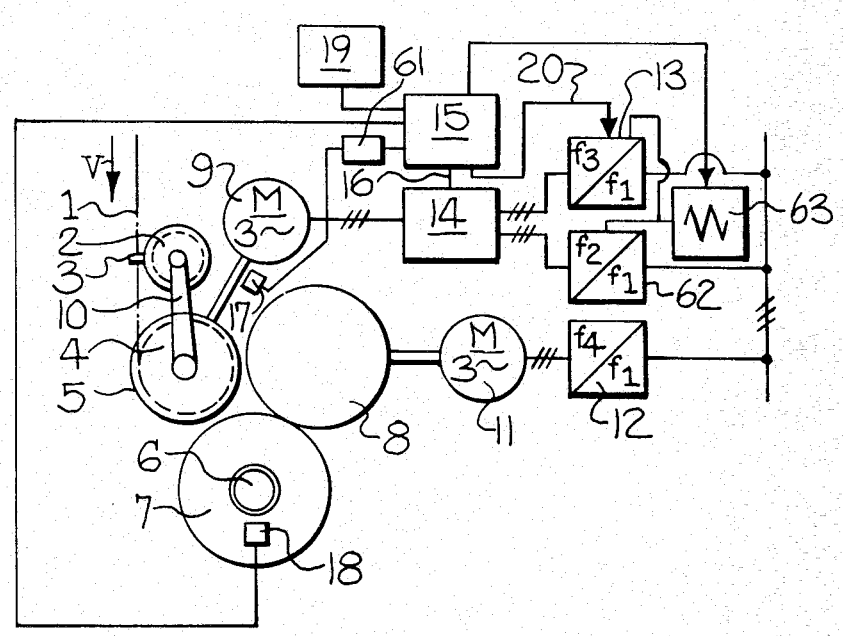

FIGS. 9 and 10 correspond generally to FIG. 5, and illustrate still further embodiments of the present invention; and FIG. 11 is generally similar to FIG. 1, but illustrates a modified construction of the invention.

Referring more particularly to the drawings, FIG. 1 shows the cross-section of a takeup machine for synthetic filament yarns. Yarn 1 travels at a constant speed v through traversing yarn guide 3, which is reciprocated perpendicularly to the traveling direction of the yarn by a cross spiralled roll 2. In addition to the traversing yarn guide 3, the traverse motion system also includes a grooved roll 4, having an endless reciprocating groove in which the yarn is guided with partial looping. The package is indicated at 7 and which is mounted on the freely rotatable winding spindle 6. A drive roll 8 rests against the circumference of package 7, which drive roll is driven at a constant circumferential speed. It should be mentioned that the drive roll and the traverse motion system on the one hand, and winding spindle and package on the other, are adapted to move radially relative to each other, so that the distance between the axes of spindle 6 and drive roll 8 increases with the increasing diameter of the package. Cross spiralled roll 2 and grooved roll 4 are driven by a three phase motor, such as an asynchronous motor 9, and are operatively connected with each other, for example, by drive belt 10. Drive roll 8 is driven by a synchronous motor 11 at a constant circumferential speed. It should be noted that the package can also be driven by a motor which drives winding spindle 6 and the speed of which is so controlled that the circumferential speed of the package remains constant, even when the package diameter increases. The three phase motors 9 and 11 receive their power from frequency converters 12 and 13. Synchronous motor 11 which serves a package drive is connected only to frequency converter 12, which supplies an adjustable frequency $f_2$. Asynchronous motor 9 is alternatively connected, via a switch 14 with frequency converter 12 or frequency converter 13, so that the traverse motion drive 9 can be operated at different speeds. A microprocessor control including a computer 15 serves to actuate the switch 14. The output signal 16 of the computer 15 depends on its input, and there is a continuous input of (1) the speed of the traverse motion device, which is determined by a measuring sensor 17 and translated to the rate of double strokes, (2) the speed of winding spindle 6, which is determined by measuring sensor 18, and (3) the output signal of programmer 19 which precedes the computer. The computer is preferably freely programmable and according to the invention stores the control parameters for breaking the ribbons, in particular, the ribbon values to be jumped, the safety distances to be maintained, the factor $p=A/2H$ or $p=A/2B$, respectively, and the ratio Q (equaling jump distance of winding ratio/safety distance, as well as the predetermined traverse speeds. If ratio Q or one of the traverse speeds or the difference of the traverse speeds are to be changed during the course of the winding cycle, another output terminal 20 for the control of frequency converter 13 is provided on computer 15.

Figure 2:
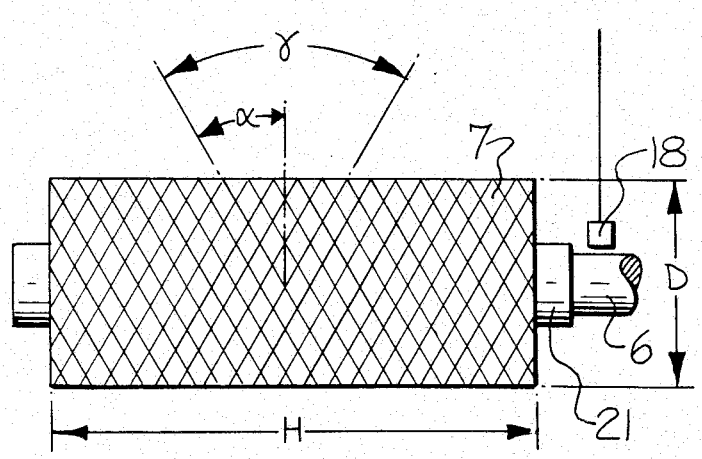

FIG. 2 is a schematic view of a cross-wound package, which is formed on a tubular core 21 placed on winding spindle 6. In addition, FIG. 2 shows the factors which are decisive for the package build. H is the winding length, and is essentially identical with the stroke of traversing yarn guide 3 or grooves 5. D represents the respective diameter of the package. Angle alpha is the angle of lead or winding angle which is measured on the package between the yarn and a tangent perpendicular to the surface line. Angle gamma is the angle at which the yarns cross each other. The characteristic of a random wind is that the angle of lead and the crossing angle remain essentially, and primarily on an average, constant during the course of a winding cycle. Deviations arise and are known to improve the package build. However, they are also provided within the framework of the present invention, especially toward the end of a winding cycle.

Figure 3A:
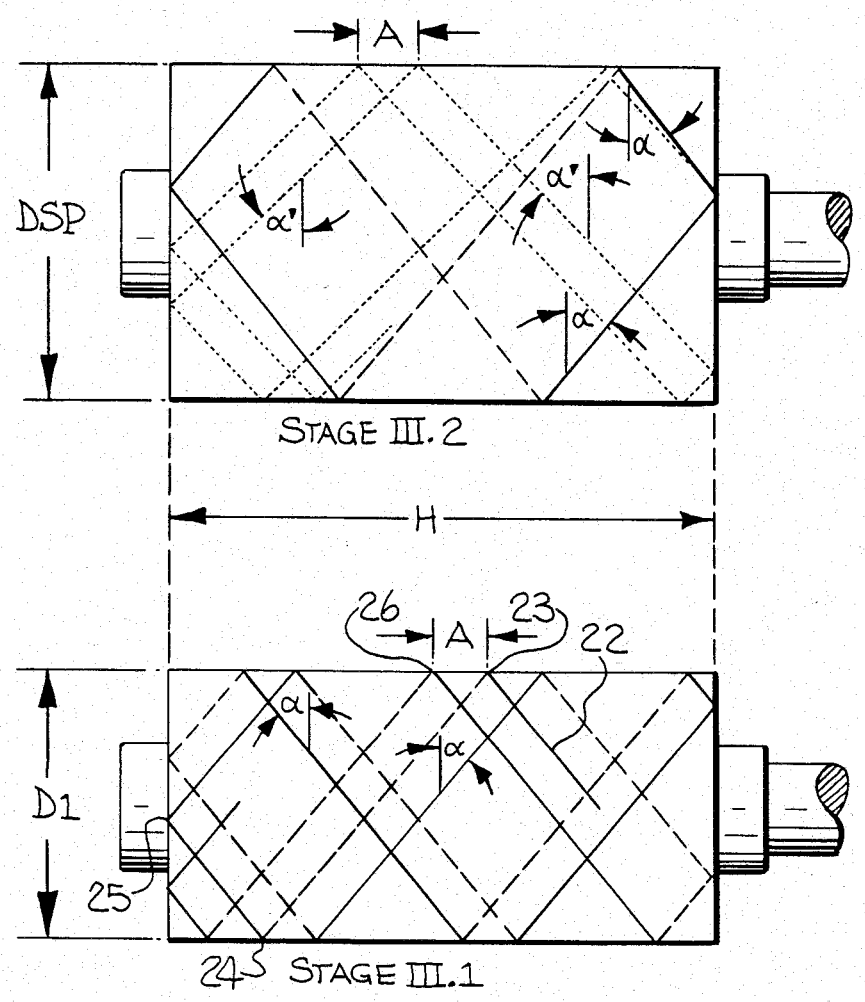

FIG. 3*a* illustrates the development of a ribbon, in particular a ribbon of second order. When the package has reached stage III.1, its diameter measures $D_1$. The yarn is wound on the package at an angle of lead alpha. The figure shows only half of the developing package circumference, and the yarn segments wound on the other half, i.e. the backside of the package, is shown in interrupted lines. The description starts with yarn segment 22, which is wound on the front side of the package. At numeral 23, this yarn segment moves to the back side of the package, and then reappears on the front side at 24. It reverses at the end of the package at 25, and the pattern repeats in the opposite direction. From this process, it results that the yarns of successive windings, measured from yarn center to yarn center on the surface line, i.e. between numerals 23 and 26, are at a distance A. Thus the yarns of successive windings are placed next to each other. However, this distance becomes smaller, when an integral winding ratio is approached.

At stage III.2 the same package is shown with the same angle of lead alpha, however, with an increased diameter DSP, at which a ribbon of the second order develops. DSP has increased to an extent that the length of the yarn wrapped once around the package is exactly the same as the stroke, that the length of two wraps equals the double stroke, and consequently, the ratio of spindle speed to rate of double strokes equals 2. As a result, two successive windings are exactly superposed, and visible markings develop on the package surface, which are described as "patterns" or "ribbons." It is easy to realize that when even a few layers of yarn are exactly on top of each other, the yarns will tend to slip off sideways and jam each other. Further, a nonuniform distribution of mass occurs over the length and/or circumference of the package. According to the invention, this is avoided by changing the winding angle in the respective critical ranges of diameter, preferably by increasing the angle as is shown in dotted lines. Thus the angle alpha is smaller than alpha prime.

Figure 3B:
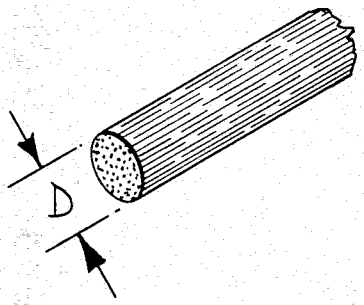
Figure 3C:
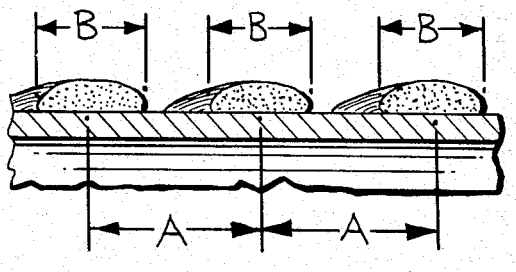

FIGS. 3*b* and 3*c* clearly show the geometric appearance of an unwound yarn and a yarn wound on a winding tube or placed on other layers of yarn. In the latter case, the yarn has a flattened width B, which can be estimated by way of calculation, for example, from the number of filaments, the denier of the filaments, as well as other winding parameters, such as the yarn tension. However, this width B can be determined more accurately when it is measured in an actual test. The center-to-center distance A between two yarns varies during the course of a winding cycle, and is zero when ribbons occur. For this distance A, a minimum value can be determined, which is determined in a winding test, and which ensures that no ribbon symptoms with a damaging effect develop.

Figure 4:
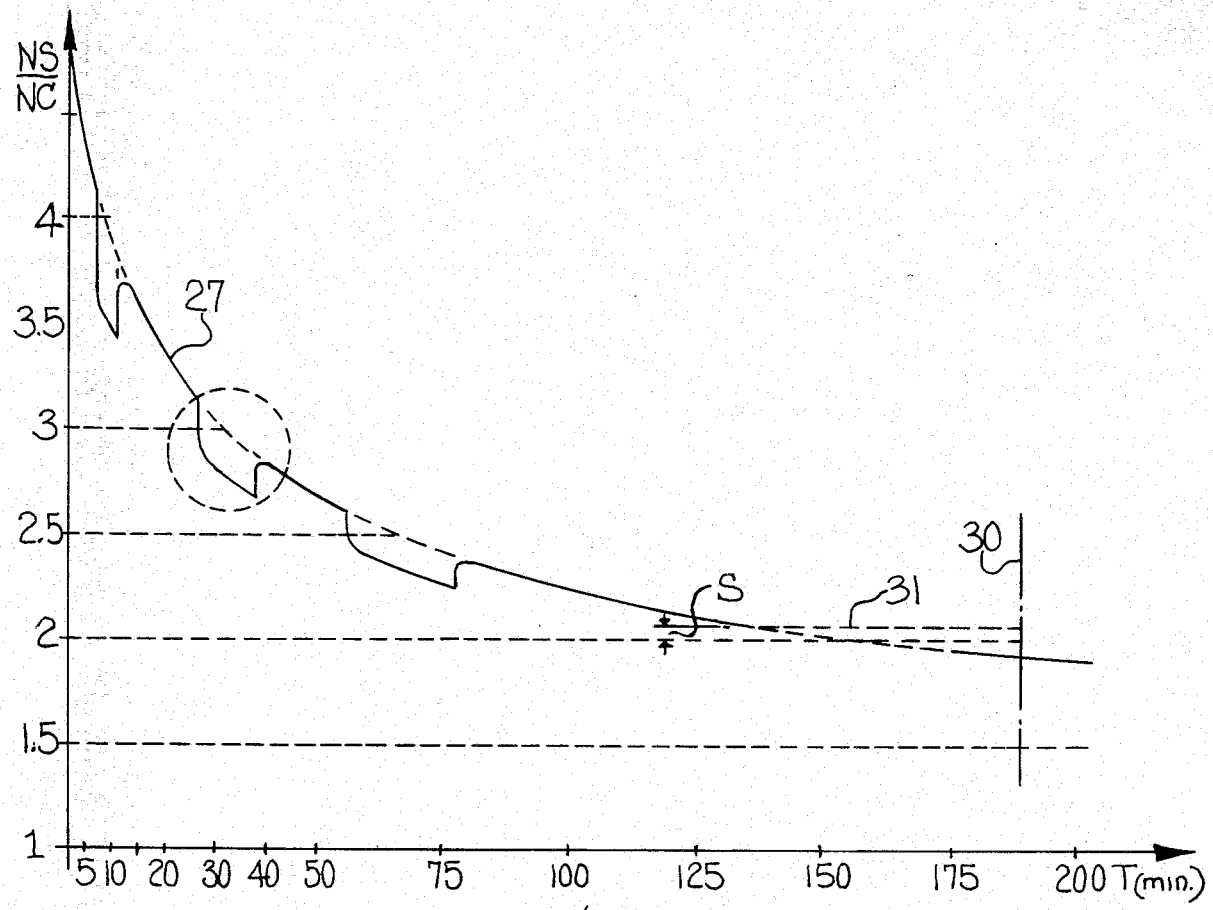

FIG. 4 illustrates, by way of a graph, an embodiment of a method according to the invention for breaking a ribbon. Curve 27 represents the winding ratio F=NS/NCA, which decreases hyperbolically during the course of a winding cycle, and which is here shown per unit time. This decrease results from the fact that the initial value NCA of the traverse speed is at least on an average constant during a random wind, whereas the spindle speed NS decreases as the package diameter increases and while the yarn speed and the circumferential speed of the package remain constant. The figure shows a package build in which ribbons ratios of the fourth, the third and the second order occur. At these points, the ribbon is jumped. In this example, it has been found useful to also jump an intermediate ribbon 2.5. It should be clearly noted that the change of the winding ratio for the purpose of jumping a ribbon is overdimensioned in the graph so as to clearly show the details. This applies particularly to the details shown in FIGS. 4*a* and 4*b*, which illustrate the breaking of a ribbon of the third order. In the present application, the winding ratio which results from the initial value NCA of the traverse speed is referred to as the initial winding ratio FA, and the winding ratio resulting from the ribbon breaking value of the traverse speed is described as the ribbon breaking winding ratio FS.

Figure 4A:
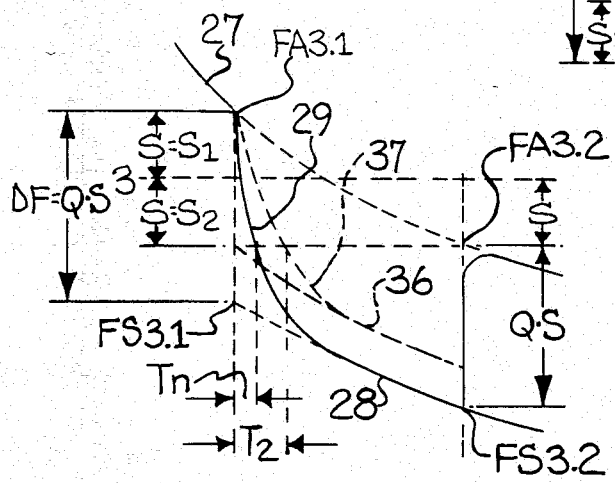

Viewing FIG. 4*a*, when the initial winding ratio FA according to curve 27 approaches the integral ribbon value 3 in the area of safety distance S, the traverse speed is switched over at winding ratio 3.1 from an initial value NCA to a ribbon breaking value NCS, and specifically, the traverse speed is increased in the illustrated embodiment. The winding ratio is thereby reduced to the ribbon breaking winding ratio FS, which according to curve 28 decreases as the spindle speed decreases. The invention provides that a value is predetermined for the safety distance S, which is proportional to the ribbon ratio and a predetermined percentage. The latter is less than about 5%. Furthermore, the jump distance DF, i.e. the difference between initial winding ratio 27 and ribbon breaking winding ratio 28, is a multiple of the safety distance at the moment 3.1 when the initial traverse speed NCA is swithed over to the ribbon breaking traverse speed NCS. Preferably, the jump distance is an integral multiple of, and at least twice, the safety distance. In the illustrated case, the jump distance equals three times the safety distance. By having a large jump distance of more than two times the safety distance, it is accomplished that the winding ratio, when passing ribbon ratio 3 and its safety range, which extends from 3+S to 3−S, changes at a high rate of acceleration, i.e. it extends very steeply. In this connection it should be noted that an infinitely rapid increase of the traverse speed is technically not feasible. Even when, as is provided by the invention, switch 14 causes a sudden change of the drive frequency from frequency $f_2$ to frequency $f_3$, and even when by a corresponding programming of computer 15 the frequency $f_3$ is temporarily increased at the moment of the switchover to a value (superposed differential increment) which is higher than the nominal frequency required for obtaining the ribbon breaking value NCS of the traverse speed, it can technically not be avoided that the winding ratio changes to the ribbon breaking winding ratio and proceeds along curve 28 only with a delay. This is shown by curve 29 which illustrates the actual curve of the changing winding ratio. According to a definition set forth below, the winding ratio changes according to a function of variation, which has a delay of the first order. Further, by the fact that n is selected greater than 2, i.e., the jump distance is more than twice the safety distance, it is accomplished that the integral ribbon ratio 3 is passed very rapidly. If the jump distance were only twice the safety distance, the curve of ribbon breaking winding ratio 36 and the actual curve 37 would be more flat, and extend less steeply through ribbon 3 than does curve 29. Consequently, the dwelling time of the traverse speed in the ribbon area, i.e., within the positive and negative safety distances, referred to at $T_2$ in FIG. 4*a*, is greater than the corresponding dwelling time, referred to at $T_n$ in FIG. 4*a*, when Q is greater than 2.

When the ribbon breaking winding ratio along line 28 has decreased, due to the increasing package diameter and the decreasing spindle speed, to the point where the winding ratio long line 27 again reaches the predetermined safety distance from the ribbon value 3, the traverse speed is reduced from its ribbon breaking value NCS to its initial value NCA, with the jump distance DF of the winding ratio again corresponding to at least two times, and specifically three times, the safety distance.

It has been indicated that the safety distance, i.e., the minimum distance of the winding ratio from a ribbon ratio is either proportional to this ribbon ratio or proportional to the respective winding ratio. In the latter case, the safety distance for winding ratio FA 3.1, i.e. the winding ratio before it reaches the ribbon ratio, is at the moment when the traverse speed is increased greater than the safety distance related to winding ratio FA 3.2, i.e. the winding ratio at the moment 3.2, when the traverse speed is reversed to its initial value. If the safety distance is always related to the respective ribbon ratio, only a very slight mathematical deviation will result, which is technically insignificant in the takeup process.

FIG. 4 futher illustrates a further aspect of the invention, in that toward the end of a winding cycle, which is shown by line 30, the passing of the last or even the last two ribbons can totally be avoided. This is accomplished by maintaining the winding ratio above the ribbon ratio, which has a value of 2 as shown. This can be done by reducing the traverse speed, preferably at the same rate as the spindle speed decreases from the increasing diameter. The winding ratio then follows along line 31, with the package being precision wound in the last part of the winding cycle, i.e. at a constant winding ratio.

Figure 6A:
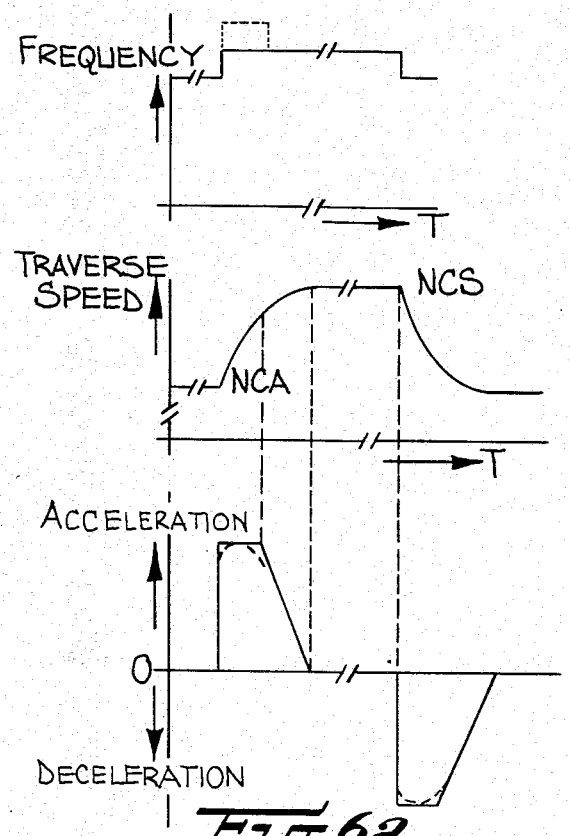
Figure 6B:
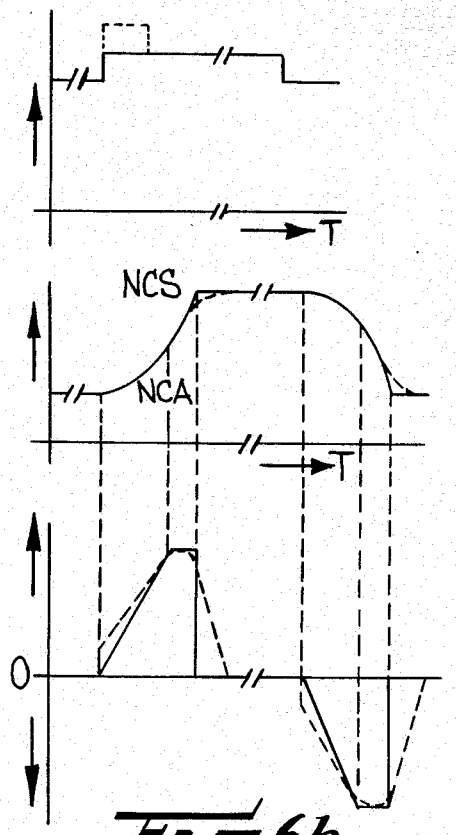

It has already been indicated that even with a sudden change of the decisive drive parameter for the traverse system, the traverse speed does not change suddenly, i.e. at an infinite acceleration. To this effect, FIGS. 6*a* and 6*b* illustrate how the traverse speed can technically be varied. The upper diagrams of FIGS. 6*a* and 6*b* show that the drive frequency of a three phase motor, which serves to drive the traverse system, may be suddenly changed, possibly by superposing a differential increment as shown in dotted lines. When electrical drives and, particularly, three phase drives are used, there will first result a sudden increase of the acceleration or deceleration, to a maximum value, note the bottom diagram in FIG. 6*a*. Then, when the three phase motor approaches its operating speed which is predetermined by the change frequency, the acceleration or deceleration drops according to a linear or nonlinear function. From this development of the acceleration, a delay of the first order results for the function defining the variation of the traverse speed, as is shown in the middle diagram of FIG. 6*a*. This means that the traverse speed first increases very suddenly, and then more gradually approaches the traverse speed which is predetermined by the new frequency.

With the use of other drives, such as for example slip clutches, the sudden change of a drive parameter first results in an acceleration or deceleration which increases from zero or from a small value. After a maximum value of the acceleration or deceleration has been reached, this change drops suddenly or steadily again back to zero, as is shown in the bottom diagram of FIG. 6*b*. Thus in this embodiment, when the traverse speed is changed to a higher or lower speed, it first follows a gradual and then a more steep curve. There can again be a delay, when the traverse speed approaches the nominal value NCA or NCS, so that the function defining the variation of the traverse speed flattens again (i.e. a delay of second or higher order). This is especially emphasized in dashed lines in the acceleration diagram (FIG. 6*b*), which shows that acceleration or deceleration need not suddenly decrease from its maximum value to zero, but may change in a steady function, for example, linearly.

Referring again to FIG. 4*a*, a method is illustrated, which according to the invention is especially used when the function defining the variation of the traverse speed is suddenly steep, and without a delay in the first phase after a switchover.

Figure 4B:
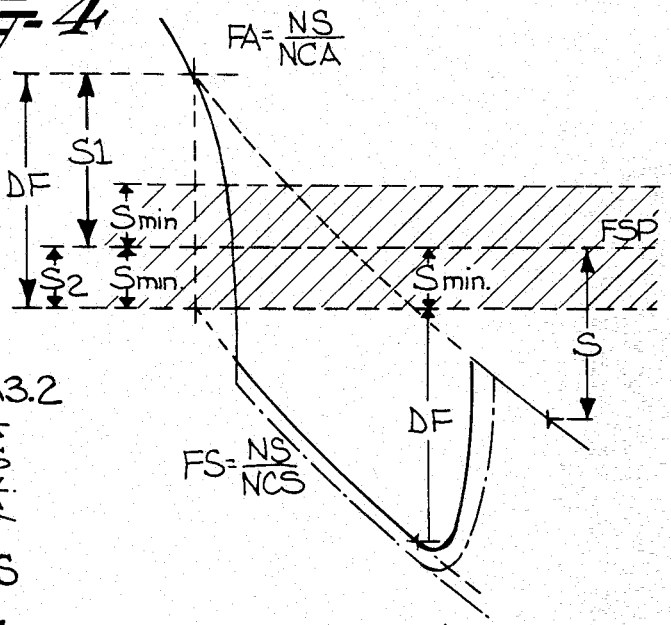

FIG. 4*b* illustrates a method according to the invention wherein the function defining the change of the traverse speed involves a delay of second or higher order. In this event, the safety distance is so selected that it is greater than the minimum safety distance.

The jump distance DF is predetermined so that the winding ratio, conditioned by the change of the traverse speed, passes through the entire safety range of the ribbon, i.e., the range from $FSP+S_{min}$ to $FSP-S_{min}$. Thus, the jump distance is at least the same as the sum of the selected safety distance and the minimum safety distance. Depending on the technically resulting function defining the variation of the traverse speed, the predetermined safety distance S and jump distance DF are so selected that, in any event, the safety range is passed in the area of the steepest slope of the function defining the variation of the traverse speed or that of the winding ratio. In the illustrated case, DF equals the sum of the selected safety distance and the minimum safety distance. If the function defining the change of the traverse speed and that of the winding factor show a greater delay when approaching a ribbon breaking ratio, DF will be predetermined greater than the sum of the selected safety distance and minimum safety distance.

In the embodiment as described in conjunction with FIG. 4*b*, the traverse speed is switched back from its ribbon breaking value to its initial value according to the principles as described in conjunction with FIG. 4*a*. Also, in determining the safety distance from the ribbon, either the minimum safety distance $S_{min}$ or the selected safety distance S may be used.

Figure 5A:
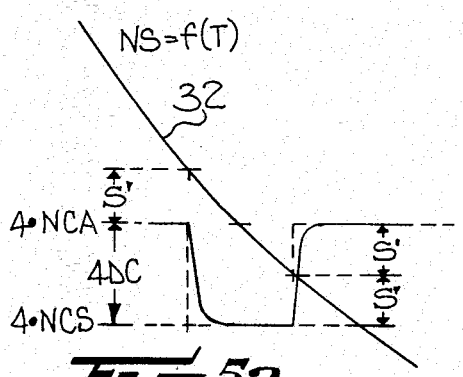
Figure 5B:
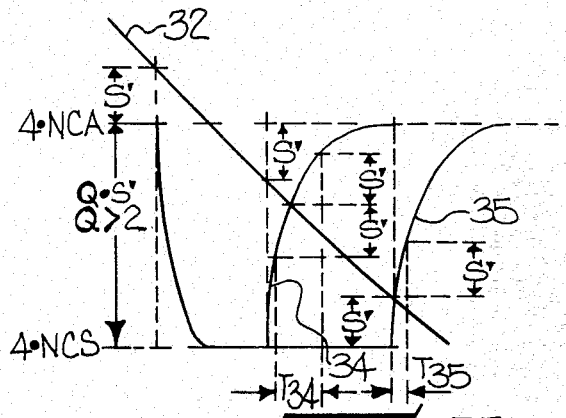
Figure 5C:
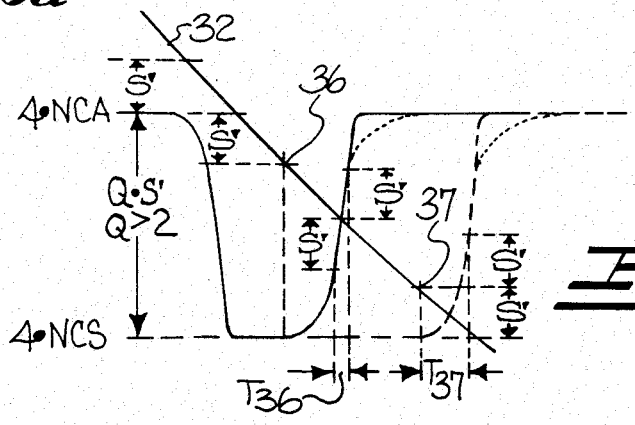

FIG. 5 is an illustration of a different embodiment according to the invention, and wherein the ribbon is broken by lowering the traverse speed. It should be noted that the kind of mathematical illustration is different from that applied to the embodiment as per FIGS. 4 to 4*b*. In FIG. 5, hyperbolic line 32 describes spindle speed NS as a function of the winding time. Further, the spindle speed is illustrated as an integral multiple of the initial value NCA of the traverse speed. The traverse speed is shown as the number of double strokes per minute by line 33. As illustrated, each time the spindle speed approaches a multiple of the traverse speed NCA, the traverse speed is changed from its initial value NCA to its ribbon breaking value NCS. The multiple corresponds with the ribbon and intermediate ribbon ratios. NCA and NCS are predetermined as constant values. The switchover process is shown in detail in FIGS. 5*a*, 5*b* and 5*c*, with FIG. 5*b* corresponding to FIG. 5 as far as the jump distance is concerned. The reduced jump distance, as shown in FIG. 5*a*, is indicated in interrupted lines in FIG. 5. FIGS. 5*a*, 5*b* and 5*c* further show how a ribbon of the fourth order is avoided.

When the spindle speed approaches an integral multiple of initial value NCA of the traverse speed, i.e., four times this initial value (4×NCA), by safety distance S', there will be a switchover. In the illustration of FIG. 5 it should be noted that $S'=S\times NC$, i.e., If $S=FSP\times A/2H$ or alternatively $S=F\times A/2H$, or $S=FSP\times B/2H$ or alternatively $S=F\times B/2H$, then $S'=FSP\times NC\times A/2H$ or alternatively $S'=NS\times A/2H$, or $S'=FSP\times NC\times B/2H$ or alternatively $S'=NS\times B/2H$.

By measuring the spindle speed and multiplying it with the constant value A/2H or, respectively, B/2H, value S' can easily be electronically determined and be inserted in the switch system. It can also be determined by measuring the traverse speed NC. In this instance then, initial value NCA or, respectively, ribbon breaking value NCS is to be multiplied with value A/2H or B/2H and the programmed ribbon ratio.

Traverse jump DC thus leads in the area of the ribbon of fourth order to the quadruple of the ribbon breaking value (4×NCS) of the traverse speed. According to the present invention, jump distance DF of winding ratio F=NS/NC equals DF=Q×S, with Q≧2. As is illustrated in FIG. 5, this means that FSP×DC=Q×S', with DC being the difference of NCA−NCS of the traverse speed. Therefore, after having predetermined Q, the ribbon breaking value of the traverse speed is to be calculated using the predetermined initial value. When value 4×NCS again approaches lines 32, i.e., the speed of the winding spindle, there will be a switchover at the latest when the distance is between NS−4×NCS=S'.

FIG. 5*b* illustrates that quotient Q is greater than 2 and that the function defining the variation of the traverse results in a delay of the first order. From this it results that the traverse speed can be returned from its ribbon breaking value NCS to its initial value NCA when the spindle speed has reached the safety distance from the integral multiple, here a quadruple, of the initial value of the traverse speed (function 34). However, the switchover may also occur at a later time, i.e. when the spindle speed 32 approaches by safety distance S' the integral multiple, here a quadruple, of the ribbon value of the traverse speed (function 35). Basically a switch from the ribbon value to the initial value can occur at any time between functions 34 and 35. A switchover at the latest possible time, i.e. when the spindle speed approaches an integral multiple of the ribbon breaking value by the safety distance is advantageous in the illustrated manner of the function defining the variation in that the ribbon with the positive and negative safety distance is passed in a very short time $T_{35}$, i.e. the function 35 defining the variation intersects function 32 defining the spindle speed with a very steep slope.

If there were an earlier switchover according to function 34, the intersection would be in an area of greater flatness so that the endangering area of the ribbon (upward and downward safety distances) would be passed in time $T_{34}$, which is greater than $T_{35}$. It should be noted that the illustration is dimensionally distorted for a better understanding. In practice, functions 34 and 35 are considerably more flat than illustrated, since the safety distance S' is exaggerated.

In the method as shown in FIG. 5*a* Q=2 was selected. From this, it results that the traverse speed has to be changed from its ribbon breaking value to its initial value, when the spindle speed reaches 4×(NCA+NCS)/2, so that at the moment of the switchover both the value FSP×NCS and the value FSP×NCA have a safety distance S' from spindle speed NS. The method shown in FIG. 5*b* with Q>2 would, however, be preferred with a function of variation with the illustrated delay of first order. In this method the ribbon breaking value of the traverse speed is maintained until the smallest safety distance and, preferably, the minimum safety distance, has been reached.

FIG. 5*c* illustrates an embodiment, in which a delay of the second order results for the function defining the variation of the traverse speed (FIG. 6*b*). Here, it is suitable and preferred to cause a return of the traverse speed from its ribbon breaking value to its initial value only when the initial winding ratio has again reached safety distance S, and preferably the minimum safety distance, from a ribbon ratio. This means, as far as the illustration in FIG. 5*c* is concerned, that the traverse speed is preferably changed from its ribbon breaking value to its initial value, when the quadruple (or other multiple of the initial value) of the traverse speed has again reached safety distance S' from the spindle speed, which is the case at switch point 36. At this switchover a passing time $T_{36}$ results, in which the winding ratio or the quadruple of the traverse speed passes through the safety range of the ribbon. If, however, a switchover occurred only when the quadruple of the ribbon breaking value of the traverse speed enters the safety distance S of the spindle speed, a passing time $T_{37}$ through the endangering area of the ribbon would result at switch point 37, which time is clearly longer than passing time $T_{36}$. Nevertheless, it may be favorable to place the switch point in the area between 36 and 37, i.e. to increase the safety distance between the multiple initial value of the traverse speed and the spindle speed, when the function defining the variation of the traverse speed shows a greater flatness as it approaches its nominal value, in particular, the initial value of the traverse speed, and as is shown in FIG. 5*c* with dotted lines. In other words, even when a method of breaking a ribbon as shown in FIG. 5 is applied, it should be noted that the traverse speed passes through the safety range of the ribbon, i.e. in FIG. 5*c* the intersection with the spindle speed, at its point of highest speed change and slope.

FIG. 5 further shows that intermediate ribbon 2.5 is jumped. However, the ribbon of the second order which is close to the end of the winding cycle (line 30)

is avoided by lowering the traverse speed at the same ratio as the spindle speed decreases.

The invention provides that the ribbons to be jumped are also freely programmable. This is based upon the recognition that it has heretofore been impossible to exactly foresee the harmfulness of ribbons. Rather, the effect of each individual ribbon is determined by tests.

It has further been found that the mass distribution of the yarn on the package depends to a very substantial extent on the maintained safety distance. This fnding is based on the fact that, at high rotational speeds, i.e. when the package diameter is small, the ribbons are locally distributed on the circumference and over the length of the package. When the spindle speeds are low, i.e. at large package diameters, and especially when the packages are short, it may be that ribbons occur over and over again at the same place on the circumference and/or length of the package over a considerable period of time. These phenomena are not limited to the ribbon ratios of the winding ratio, but may in certain circumstances also occur spaced apart from the ribbon ratios and intermediate ribbon ratios. For this reason, the invention provides that the safety distance is freely programmable as a function of the ribbons and intermediate ribbons. For this purpose, in particular, factor P=S/FSP can be variably programmed.

It is further provided that the ratio Q=DF/S is predetermined as a function of the ribbon ratios to be jumped, and, preferably, is freely programmable. In doing so, it can be accomplished that ribbon ratios which have been found particularly critical in tests can be passed at a high acceleration or deceleration of the traverse speed.

The safety distance (S1) of a winding ratio approaching a ribbon can be predetermined differently from the safety distance (S2) of the winding factor after the switchover, or the ratio S1/S2 may be variable.

It should be mentioned that the traverse speed need not be exclusively varied by electric means. Especially in textile machines with a central traverse motion drive for several takeup positions (for example, texturing machines), the traverse motion devices of the individual takeup positions can be selectively driven by two shafts rotating at different speeds, via suitable couplings, freewheeling drives, overriding clutches or other operative connections. These operative connections may be so connected and disconnected that, according to the invention, the safety distance of the winding ratio from integral or intermediate ribbon ratio is maintained, and the initial value and the ribbon breaking value of the traverse speed are so adjusted that the change of the winding ratio, which is caused by the switchover of the traverse speed, amounts to at least twice the safety distance. It should be noted that a greater variation of the traverse speed is possible for textured yarns, since, when they are processed, the yarn tension changes relatively little.

Figure 7:
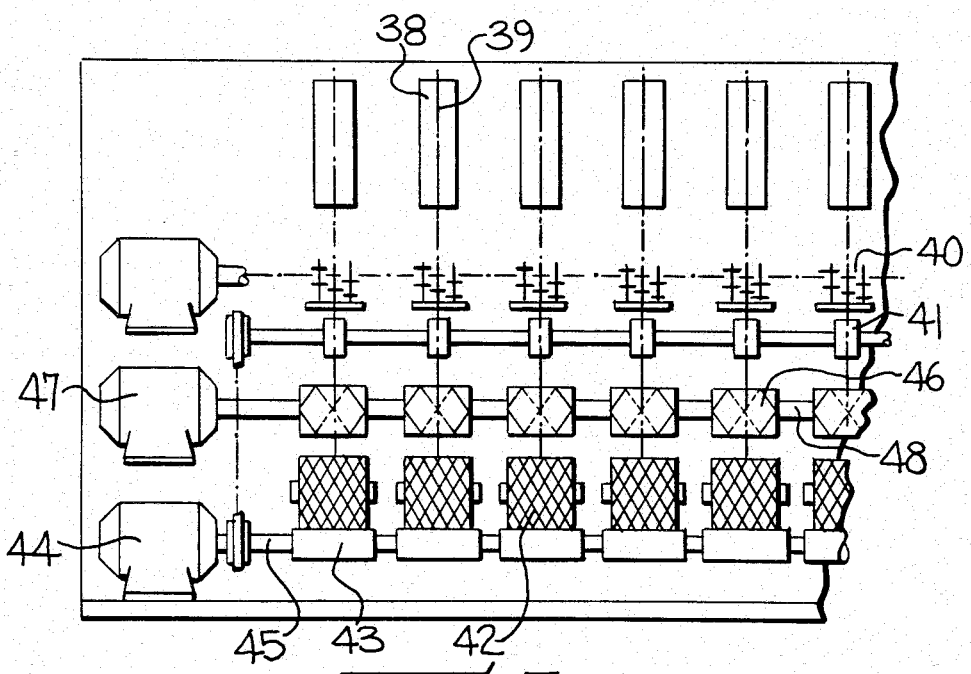
FIG. 7 is a schematic view of a textile machine having a plurality of working positions, and which embodies the present invention.

FIG. 7 shows a textile yarn texturing machine having a plurality of working positions for processing synthetic filament yarns. Illustrated are a heater 38, yarn 39, false twist spindle 40, a second feed system 41, takeup package 42, drive roll 43, drive roll motor 44, drive shaft 45 connected to the motor 44. Also included are a grooved drum or cross spiralled shaft 46, traverse motion drive motor 47, and drive shaft 48 on which a plurality of grooved drums are mounted, and which extends in the longitudinal direction of the machine.

Figure 8:
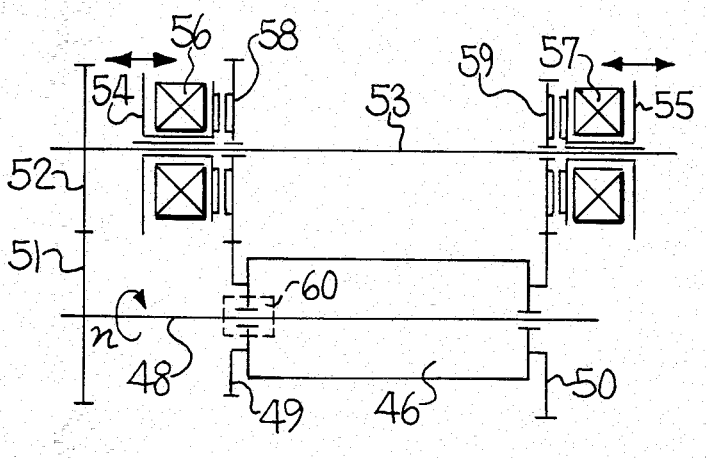
FIG. 8 is a schematic view of the drive of a grooved traverse drum in accordance with the present invention.

FIG. 8 is a schematic view of the drive of a grooved drum 46. Grooved drum 46 is freely rotatably mounted on drive shaft 48, and it mounts end gears 49 and 50, which are slightly different in size. Drive shaft 48 drives, via gear 51 and gear 52, transmission shaft 53 with the axially displaceable couplings 54 and 55. The couplings can be pulled by stationary magnets 56, 57 against the friction coatings of gears 58 and 59. Gears 58 and 59 are freely rotatably mounted on transmission shaft 52 and are in engagement with gears 49 and 50 of the grooved drum. By alternatively actuating couplings 56 and 57, the grooved drum can be driven at a slightly different speed. As described in conjunction with FIG. 1, the couplings are alternately activated by a computer and a programmer. One of the gear or coupling connections (for example, gears 50, 59, coupling 55 and magnet 57) may be replaced by a directionally controlled freewheeling coupling 60 (see Dubbel, Taschenbuch fuer den Maschinenbau [Manual on Mechanical Engineering] 14th edition, 1981, page 414), which transmits the slower speed of drive shaft 48 directly to grooved drum 46, whereas the faster speed of the grooved drum is generated via the operative connection of gears 51, 52, 58, 49, when coupling 56 is actuated. Furthermore, in particular, with the use of a freewheel mechanism 60 in the place of parts 50, 59, 57, 55, an independent drive of shaft 53 may be substituted for the gear connection 51, 52.

Thus far, the invention has dealt with the prevention of ribbon symptoms in that the traverse speed is temporarily changed to a ribbon breaking value, when a winding ratio approaches a ribbon ratio, and that, in doing so, the ribbon ratio is rapidly passed in one reciprocating motion. This method permits for the first time the production of packages of spun or spun-drawn synthetic filament yarns with a large diameter and with certain characteristics. Since ribbon symptoms occur in many intermediate ribbons, and since ribbons and intermediate ribbons are often very close to each other, the thus far described method cannot completely avoid all potential ribbon symptoms, such as might occur when upon changing the traverse speed from its initial value to a ribbon breaking value, the ribbon breaking value would be in the area of an intermediate ribbon. In such case, the traverse speed should not be changed to its ribbon breaking value, or the ribbon symptoms occurring after the change to the ribbon value will have to be accepted as the lesser evil. Likewise, it can happen that the traverse speed is changed with a delay, i.e., by disregarding the safety distance, since otherwise there is the risk of eaching ribbon or intermediate ribbon areas by a change of the traverse speed. To eliminate these disadvantages and to avoid ribbon symptoms which may not make a change of the traverse absolutely necessary, but which are disadvantageous, it is further proposed to oscillate (wobble) at least the initial value of the traverse speed constantly between a maximum and a minimum value. This periodic or aperiodic variation of the traverse speed about an average value for the purpose of breaking a ribbon is known per se. Oscillating the initial value of the traverse speed makes it unnecessary to change the traverse speed in the case of certain ribbons or intermediate ribbons having only slight ribbon symptoms. Alternatively, the traverse speed may be changed at a reduced safety distance.

When, as is further provided, the ribbon breaking value of the traverse speed is oscillated, the ribbon symptoms which occur in the intermediate ribbon area of the ribbon breaking value of the traverse speed can be avoided or eased.

The oscillating procedure may also be utilized in the area of integral ribbons, in particular, in the area of high integral ribbons. However, the oscillating procedure is preferably applied in the area of intermediate ribbons, in particular, intermediate ribbons of a lower order.

By combining, according to the present invention, the ribbon breaking procedure by jumping ribbon values and by upward and downward variation between extreme values of the initial and/or ribbon braking values of the traverse speed, it is possible to produce packages having a large volume, a high ratio of diameter to stroke, and a nearly perfect yarn quality, in particular uniformity and uniform dyeability. The package further has excellent unwinding characteristics, even when the yarn is withdrawn overhead from the package at high unwinding speeds of, for example, more than 1,000 m/min., including overhead yarn withdrawal without break and without fluctuations of the yarn tension. The package is also suitable for yarns with unfavorable winding characteristics, such as for example hosiery yarn or yarns with low-denier individual filaments.

When an oscillating is superposed, the invention provides that the safety distance of the winding ratio from the ribbon ratio is measured from the mean value of the winding ratio, which results from the average oscillated traverse speed (initial value or ribbon breaking value). This mean value of the safety distance is determined according to the specification of the present invention, and it is preferably greater than the amplitude of the winding ratio which results from oscillating the traverse speed. That implies that the extremes values of the winding ratio which result from oscillating the traverse speed do not reach a ribbon or intermediate ribbon. It is also preferred that the extreme values of the winding ratio maintain a safety distance, which however can be very small, since the extreme values of this winding ratio are always passed quickly. However the extreme values of the winding ratio should maintain a minimum safety distance, which is according to the present invention: $S_{min}=FSP\times Pmin=FSP\times B/2H$.

The amplitude of the oscillation is preferably adapted to the minimum safety distance. For this purpose, it is preferred that the percentage a of the oscillation essentially equals factor p, applying here preferably: $a=B/2H$, with a being AMP/NC=maximum value of the traverse speed−average value of the traverse speed/average value of the traverse speed; AMP being the amplitude of the oscillated traverse speed, B being yarn width, as previously defined, and H being the traverse stroke length of the package, as previously defined.

Therefore, the safety distance according to the present invention, should in any event be greater than the amplitude of the winding ratio in the ribbon area, this amplitude being calculated according to the formula: $F\times a/1+a$ or $FSP\times a/1+a$, which is about the same. Preferably, however, the extreme values of the oscillation maintain a minimum safety distance. In this case, the safety distance is greater than the sum of minimum safety distance $FSP\times Pmin$ plus the amplitude of the winding ratio in the ribbon area, with the minimum distance of the extreme value of the winding factor from the ribbon values being described Z and preferably equalling $FSP\times B/2H$.

The oscillation procedure also offers a possibility which may be used under circumstances, i.e., the possibility of more closely approaching ribbon ratios with the extreme values of the winding ratio.

The average value of the traverse speed, which is decisive for determining the switchover points, is, even when oscillation is superposed, preferably determined by measuring and further by integrating the continuously measured oscillation ratios.

As already explained, it is not necessary to oscillate in all stages of the winding cycle. It is, therefore, proposed to predetermine the oscillation times as a function of the ribbons. Therefore the specific oscillation times may be determined by test. Likewise, the oscillation can be predetermined and programmed according to the duration and its relative amplitude $a=NC_{max}-NC_m/NC_m$ as a function of the ribbons. The relative amplitude is preferably identical for the initial value NCA and the ribbon breaking value NCS of the traverse speed.

It should be mentioned that, when in known manner a stroke modification (stroke reduction) is additionally superposed, the modified stroke movement of the traverse motion device and the oscillation movements are so adapted to each other that the resulting yarn speed remains essentially constant.

Embodiments in which a ribbon breaking is superposed by a jump of the winding ratio and oscillation of the traverse speed, are described in conjunction with FIGS. 9–11.

The selected illustration in FIGS. 9 and 10 corresponds with that in FIG. 5. The method is explained in connection with a ribbon of the fourth order, which deveops when four times the average value of the initial value of the traverse speed equals the spindle speed, i.e. $4\times NCS=NS$. According to the invention, the traverse speed is changed to its ribbon breaking value, when the average value of the initial value NCAM reaches the safety distance S′ from the spindle speed. S′ is here predetermined so great that also a minimum safety distance Z′ still remains between the extreme values of the quadruple traverse speed and the spindle speed. Thus, Z′ preferably equal the minimum safety distance $S_{min}$ in the sense of the present invention.

As is shown in FIG. 9, the ribbon breaking value of the traverse speed MCSM is greater than its initial value NCAM, and factor Q is greater than 2.

As is shown in FIG. 10, the ribbon breaking value NCSM of the traverse speed is less than its initial value NCAM. Factor Q again equals 2.

It should be especially emphasized that in order to achieve a change of the traverse speed or of the winding ratio as suddenly as possible, the time of change and the oscillation should be interrelated to each other so that the direction of change of the traverse speed always conforms with the oscillation direction, as is shown in FIGS. 9 and 10. Since in FIG. 9, the traverse speed is increased to its ribbon breaking value when its initial value approaches the spindle speed, the change in value should also occur when traverse speed is increasing. This applies, in particular, when by the change of the traverse speed a ribbon area is passed, as is done when the initial value is changed to the ribbon breaking value (FIG. 9), and when the ribbon breaking value is returned to the initial value (FIG. 10).

Superposing the ribbon breaking procedures according to the invention requires a modification of the embodiment illustrated in FIG. 1. Such modification is shown in FIG. 11, wherein an integrator 61 is used which integrates the continuously measured values of the traverse speed, which are received by sensor 17, to an average value. Further, an additional frequency converter 62 is utilized. Both frequency converters 13 and 62 supply the drive frequencies for the initial value or, respectively, the ribbon breaking value of the traverse speed. Frequency converter 12 applies only to the drive of drive roll 8. Frequency converters 13 and 62 are controlled by an oscillation generator 63, which superposes an oscillation frequency upon the average nominal frequency for the initial value and ribbon breaking value of the traverse speed. Oscillation generator 63 may be controlled by programmer 19 via computer 15.

In the drawings and specification, there has been set forth a preferred embodiment of the invention, and although specific terms are employed, they are used in a generic and descriptive sense only and not for purposes of limitation.

That which is claimed is:

1. An apparatus for winding a textile yarn into a core supported package and including means for rotating the core to wind the yarn thereabout at a substantially constant rate, yarn guide means movable axially of the core for guiding the yarn onto the core, and means for traversing said yarn guide means and including a drive shaft and a grooved drum mounted for rotation about the axis of said drive shaft, and wherein the winding ratio (F), which is defined as the ratio of the rotational speed of the package (NS) to the double stroke rate of the yarn guide (NC), gradually decreases as the package builds, the improvement therein comprising means for storing a plurality of predetermined critical winding ratios (FSP) at which undesirable pattern formations would normally occur, means for storing a predetermined safety distance (S) from each of said critical winding ratios, means for continuously comparing the actual winding ratio with the stored critical winding ratios, and drive control means for selectively operating said traversing means at one of either an initial double stroke rate (NCA), or a second difficult double stroke rate (NCS), and including a transmission shaft disposed parallel to said drive shaft, means for rotating at least said transmission shaft, first coupling means operatively connected between said grooved drum and said transmission shaft for rotating the drum at a first speed, and second coupling means operatively connected between said grooved drum and one of said shafts for rotating the drum at a second different speed, and such that the double stroke rate may be rapidly changed from said one rate to the other rate upon the distance between the actual winding ratio and an approaching critical winding ratio being the same as said predetermined safety distance, and so that the actual winding ratio moves rapidly through such critical winding ratio.

2. The apparatus as defined in claim 1 wherein the winding ratios calculated from said initial and second double stroke rates differ by an amount equal to at least twice said safety distance.

3. The apparatus as defined in claim 2 wherein the means for rapidly changing the double stroke rate includes means for changing the rate in a steplike manner with the acceleration or deceleration thereof being at its highest value immediately after commencement of the change.

4. The apparatus as defined in any one of claims 1–3 wherein said drive control means further includes means for changing the double stroke rate from said other rate back to said one rate upon at least the safety distance being reached beween the critical ratio and a winding ratio as calculated from the then rotational speed of the package and said one double stroke rate.

5. The apparatus as defined in claim 1 wherein said shaft rotating means acts to rotate both said transmission shaft and said drive shaft, and said second coupling means is operatively connected between said grooved drum and said drive shaft.

6. The apparatus as defined in claim 1 wherein said second coupling means is operatively connected between said grooved drum and said transmission shaft and has a different transmission ratio from that of said first coupling means.

* * * * *

UNITED STATES PATENT AND TRADEMARK OFFICE

CERTIFICATE OF CORRECTION

PATENT NO. : 4,504,021

DATED : March 12, 1985

INVENTOR(S) : Heinz Schippers et al

It is certified that error appears in the above-identified patent and that said Letters Patent is hereby corrected as shown below:

Column 2, line 20, after "continuously" insert -- or --.

Column 3, line 30, "values" should be -- value --.

Column 5, line 53, "thwe" should be -- the --.

Column 7, line 55, "thereby" should be -- hereby --.

Column 12, line 48, "swithed" should be -- switched --.

Column 17, line 10, "fnding" should be -- finding --.

Column 18, line 10, "52" should be -- 53 --.

Column 18, line 51, "eaching" should be -- reaching --.

Column 19, line 11, "braking" should be -- breaking --.

Column 19, line 33, "extremes" should be -- extreme --.

Column 20, line 31, "deveops" should be -- develops --.

UNITED STATES PATENT AND TRADEMARK OFFICE

CERTIFICATE OF CORRECTION

PATENT NO. : 4,504,021

DATED : March 12, 1985

INVENTOR(S) : Heinz Schippers et al

It is certified that error appears in the above-identified patent and that said Letters Patent is hereby corrected as shown below:

Column 20, line 33, "NCS" should be -- NCA --.

Column 20, line 40, "equal" should be -- equals --.

Column 21, line 39, "difficult" should be -- different --.

Signed and Sealed this

*Seventeenth* Day of *September 1985*

[SEAL]

*Attest:*

DONALD J. QUIGG

*Attesting Officer*

*Commissioner of Patents and Trademarks—Designate*